US007318261B2

(12) United States Patent
Bills

(10) Patent No.: US 7,318,261 B2
(45) Date of Patent: Jan. 15, 2008

(54) SYNTHETIC BIOMETRIC ARTICLE AND METHOD FOR USE OF SAME

(76) Inventor: Michael A. Bills, 308 Woodland Trail, Keller, TX (US) 76248

( * ) Notice: Subject to any disclaimer, the term of this patent is extended or adjusted under 35 U.S.C. 154(b) by 12 days.

(21) Appl. No.: 11/317,723

(22) Filed: Dec. 24, 2005

(65) Prior Publication Data

US 2006/0137154 A1 Jun. 29, 2006

Related U.S. Application Data

(60) Provisional application No. 60/638,683, filed on Dec. 24, 2004.

(51) Int. Cl.
*A61G 17/00* (2006.01)

(52) U.S. Cl. ..... 27/1; 40/633; 63/3; 110/194

(58) Field of Classification Search ..... 27/1; 40/633; 63/3, 3.1; 110/194, 341
See application file for complete search history.

(56) References Cited

U.S. PATENT DOCUMENTS

| | | | | |
|---|---|---|---|---|
| 3,869,596 | A * | 3/1975 | Howie | 219/438 |
| 4,168,586 | A * | 9/1979 | Samis | 283/70 |
| 4,201,347 | A | 5/1980 | Elkin | |
| 4,473,012 | A | 9/1984 | Duran | |
| 4,753,176 | A | 6/1988 | Duran | |
| 6,227,284 | B1 * | 5/2001 | Cannon | 164/516 |
| 6,258,320 | B1 * | 7/2001 | Persing et al. | 422/40 |
| 6,948,271 | B2 | 9/2005 | Helgeson et al. | |

OTHER PUBLICATIONS

McEwen, Craig. "Adding Peace of Mind: Tag System Tracks Cremated Remains." In-forum.com. Jun. 22, 2004.

* cited by examiner

*Primary Examiner*—William L. Miller
(74) *Attorney, Agent, or Firm*—Scott T. Griggs; Griggs Bergen LLP

(57) ABSTRACT

A synthetic biometric article for use in a cremation process is disclosed. The synthetic biometric article comprises a body, which is to be placed with a deceased individual, including a cremation compatible material that is suitable for mechanical pulverization. At least one synthetic biometric is integrated into the cremation compatible material in order to provide for continuous positive identification of the deceased individual during the cremation process.

11 Claims, 5 Drawing Sheets

SYNTHETIC BIOMETRIC ARTICLE AND METHOD FOR USE OF SAME

PRIORITY STATEMENT & CROSS-REFERENCE TO RELATED APPLICATIONS

This application claims priority from co-pending U.S. patent application No. 60/638,683, entitled "Synthetic Biometric Article and Method for Use" and filed on Dec. 24, 2004, in the name of Michael A. Bills; which is hereby incorporated by reference for all purposes.

TECHNICAL FIELD OF THE INVENTION

This invention relates, in general, to the process of cremation and, in particular, to a synthetic biometric article that provides for the continuous positive identification of a deceased individual throughout all stages of the cremation process.

BACKGROUND OF THE INVENTION

Many considerations must be taken into account when a crematory is entrusted with the disposition of human remains. Among these, the positive identification of the deceased individual from extant corpus to cremated remains is critical to the piece of mind of the deceased individual's family and loved ones. Cremated remains pose certain identification challenges to crematories, however, since cremated remains retain no characteristics that make them identifiably unique from one another. All cremated remains are very similar in consistency and only vary slightly in shades of grey color.

Existing cremation techniques use metal tokens, such as steel tags, heavy gauge metal discs, or metal bands, to track and identify an individual during all the stages of the cremation process. Each metal token is imprinted with a unique number that serves as a unique identifier for the deceased individual. The metal tokens, however, are not able to be integrated with the individual during all stages of the cremation process. Accordingly, the existing tokens do not provide a continuity of positive identification throughout all of the stages of the cremation process.

More specifically, the direct flame and heat used to reduce the human remains to bone fragments discolor and burn the metal tokens rendering them unreadable. Hence, the metal tokens are removed from the individual before placing the individual into the cremation chamber and re-associated with the individual after the individual is reduced to bone fragments. Further, the metal tokens can damage the mechanical pulverization equipment that is utilized to reduce the bone fragments to granulated particles. Therefore, the metal tokens are removed from the individual before placing the individual's bone fragments into the mechanical pulverization equipment and re-associated with the individual after the reduction to granulated particles is complete. Accordingly, a need exists for a cremation technique that provides for improved and positive identification of an individual's remains continuously through all stages of the cremation process.

SUMMARY OF THE INVENTION

The synthetic biometric article and method for use of the same disclosed herein provide for the continuous and uninterrupted, positive identification of a deceased individual through all stages of the cremation process. In one embodiment, the synthetic biometric article comprises a body, which is to be placed with a deceased individual, including a cremation compatible material that is suitable for mechanical pulverization. At least one synthetic biometric is integrated into the cremation compatible material in order to provide for identification of the deceased individual during the cremation process.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
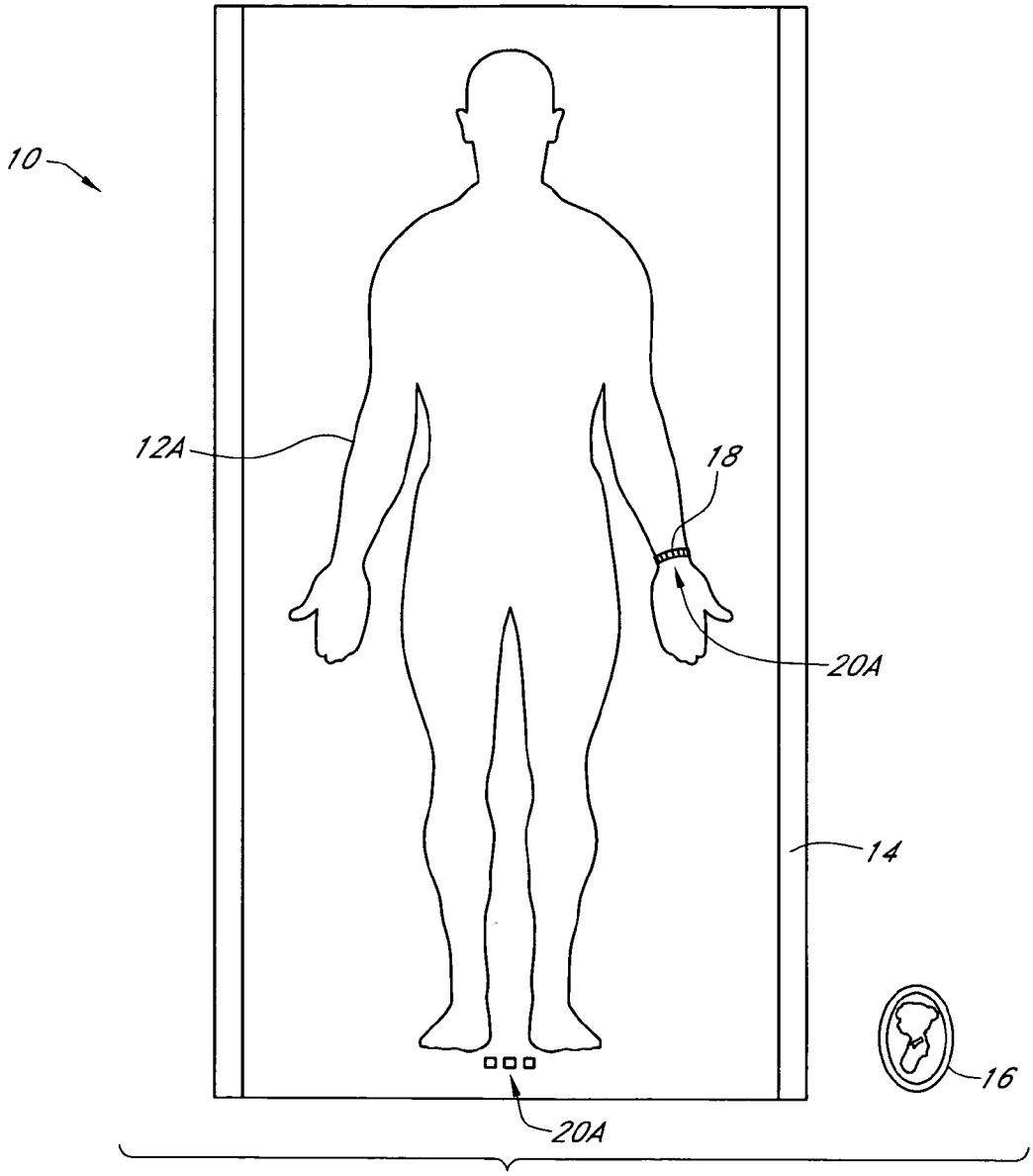
FIG. 1 depicts a schematic view of a deceased individual being prepared for a cremation process which utilizes the synthetic biometric articles taught herein.

FIG. 1 depicts cremation preparation 10 wherein a deceased individual 12A is positioned on a surface 14 and all medical devices such as pacemakers, prosthetics, and other non-combustibles and potentially hazardous materials are removed from the deceased individual 12A. A cremation cameo 16 and a synthetic biometric article or articles 20A are selected for the deceased individual and placed with the deceased individual. The synthetic biometric articles 20A provide continuous positive identification of the deceased individual 12A during the cremation process. As illustrated, two embodiments of synthetic biometric articles 20A have been selected.

Tile embodiments of the synthetic biometric articles 20A are positioned proximate to the feet of the deceased individual 12A and a bracelet 18, which may be considered a wrist or angle band embodiment, having synthetic biometric articles 20A mounted thereto is attached to the wrist. In general, the synthetic biometric articles 20A may be placed on top of or proximate to the deceased individual 12A and the bracelet 18 incorporating the synthetic biometric articles 20A may be appropriately strapped to the deceased individual 12A on the wrist or angle, for example.

It should be appreciated that the synthetic biometric articles 20A may take different forms. Regardless of the form selected for the synthetic biometric article, as will be discussed in further detail hereinbelow, each synthetic biometric article of the synthetic biometric articles 20A may comprise a cremation compatible material and a synthetic biometric. The cremation compatible material should be able to withstand temperatures as high as approximately 1600° F. (871° C.) to 1800° F. (982° C.) in order to survive the direct flame and heat used to reduce the human remains to bone fragments. The cremation compatible material, which may be of any shape and size or artistic presentation, should also be frangible so that mechanical pulverization equipment utilized during the cremation process is not damaged when the human remains are further reduced from bone fragments to granulated particles.

Suitable cremation compatible materials include porcelains, ceramics, polymers, and composites, for example. Porcelains have been found to be particular suitable. Porcelain is potassium aluminum silicate ($4K_2O.Al_2.3SiO_2$), which is a mixture of clays, quartz, and feldspar usually containing at least 25% alumina. In one implementation, the porcelain is prepared with ball or china clays that are utilized with water to form a plastic, moldable mass that is glazed and fired to a hard, smooth solid. Porcelain prepared in this fashion may be exposed to temperatures as high as 1994° F. (1093° C.). It should be appreciated that other types of porcelain are within the teachings of the present invention. For example, zircon porcelain ($ZrO_2.SiO_2$), which is a special high temperature porcelain that is usable up to 3092° F. (1700° C.), may be utilized.

Suitable ceramics include products that are manufactured by the action of heat on earthy raw materials, in which silicon and its oxide and complex compounds known as silicates occupy a predominant position. Composites are mixtures or mechanical combinations on a macroscale of two or more materials that are solid in the finished state, are mutually insoluble, and differ in chemical nature. Suitable composites include cermets, which are a mixture of ceramic and metal powders that are heat treated and compressed. Suitable composites also include fiber composites comprising boron, aluminum silicate or silicon carbide in combination with glass fibers or a thermosetting resin may also be acceptable.

As previously discussed, one or more synthetic biometrics are integrated into the cremation compatible material. The synthetic biometric or synthetic biometrics should maintain their ability to identify the human remains through the entirety of the cremation process. Suitable synthetic biometrics include color identification (heat resistant colored pigments), radio frequency identification (RFID) tags, micro particle identification resins, and chemical identification tags, for example.

Figure 2A:
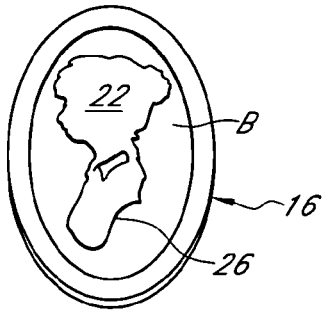
FIG. 2A depicts a front plan view of one embodiment of the cameo presented in FIG. 1.
Figure 2B:
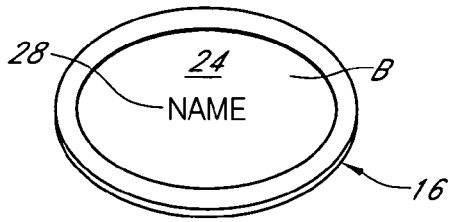
FIG. 2B depicts a rear plan view of the cameo of FIG. 2A.

FIGS. 2A and 2B depict the cameo 16 presented in FIG. 1 in further detail. The cameo 16 includes a front side 22 and a rear side 24 and corresponds to the synthetic biometric articles 20A in that the cameo 16 includes the same cremation compatible material and synthetic biometric or biometrics. For example, the cameo 16 is molded from porcelain and a heat resistant colored pigment is integrated into the cremation compatible material so that an individual is associated with a particular color, such as blue, as represented by the letter B. The blue pigment may be introduced into the cameo during the manufacturing of the porcelain. As will be discussed hereinbelow, in the illustrated embodiment, the synthetic biometric articles 20A are also manufactured from porcelain and include a blue heat resistant colored pigment integrated therewith.

In one implementation, the crematory rotates the assignment of a selection of colors, such as red, blue, yellow, and green, to positively identify human remains. In other implementations, the family or loved ones in association with the funeral home select the color or colors for the deceased individual.

The cameo 16 serves as an escort to the human remains throughout the process and as a reference key for the synthetic biometric articles 20A. In particular, a one-to-one correspondence is present between the synthetic biometric utilized in the synthetic biometric article and the synthetic biometric utilized in the cameo 16. For example, if the synthetic biometric is blue in the synthetic biometric article, then the synthetic biometric utilized in the cameo 16 is blue too. By way of another example, if the synthetic biometric is an RFID having a frequency of $rf_1$, then the synthetic biometric utilized in the cameo 16 is an RFID having a frequency of $rf_1$ as well.

Since the cameo serves as a reference key for the synthetic biometric article and, preferably, since the cameo is not destroyed during the cremation process, the cameo may include additional information that identifies the deceased individual 12A such as a relief carving or symbol of importance to the deceased individual 12A and/or the individual's name. For example, the cameo 16 includes a relief carving showcasing a woman's profile 26 on the front side 22 while the back side 24 of the cameo 16 bears the name 28 of the deceased individual in a special heat resistant ink. Alternatively, the front side 22 may depict another portrait or a religious symbol, such as a cross, for example. It should be appreciated that other forms of documentation, such as papers and computer records, may accompany or replace the cameo 16 as documentation for the remains of the deceased individual.

Figure 3:
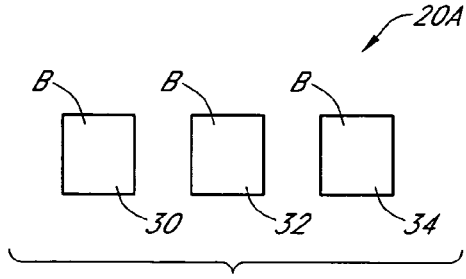
FIG. 3 depicts a front plan view of the synthetic biometric articles presented in FIG. 1.

FIG. 3 depicts the synthetic biometric articles 20A of FIG. 1 which are positioned proximate to the feet of the deceased individual. Each of the synthetic biometric articles 20A respectively includes a body 30-34 of a cremation compatible material such as porcelain wherein a blue heat resistant colored pigment as represented by the letter B is integrated into the cremation compatible material. It should be appreciated that although only one color is depicted, the synthetic biometric may comprise any color or a combination of colors. Further, different types of synthetic biometrics such as color and RFID may be used together.

During use, the synthetic biometric articles 20A may be become fragmented and intermixed with the human remains, however, the synthetic biometric articles 20A remain the color blue due to the heat resistant colored pigment. Therefore, in the illustrated embodiment, the color of the synthetic biometric articles 20A provides a synthetic biometric for continuously identifying the human remains.

Figure 4:
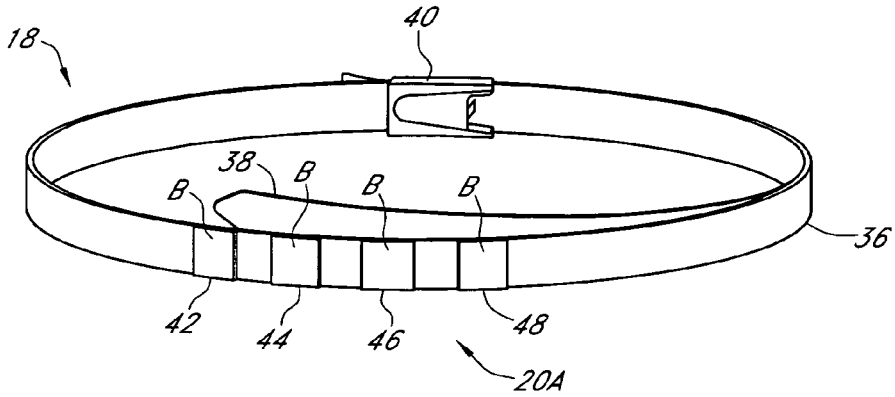
FIG. 4 depicts a perspective view of the bracelet having the synthetic biometric articles presented in FIG. 1.

FIG. 4 depicts the bracelet 18 of FIG. 1 in further detail. This wrist or angle band embodiment includes a strap or band 36 having an end 38 for securably engaging a clasp 40 and fitting the synthetic biometric articles 20A to a wrist or angle. As depicted, four bodies 42-48 of a cremation compatible material such as the aforementioned porcelain having a blue heat resistant colored pigments, as represented by the letters B, are affixed to the band 36. During use, the wrist band is destroyed by the cremation process and the synthetic biometric articles 20A separate and disburse throughout the human remains. The four bodies 42-48 retain their blue color which servers to continuously identify the human remains throughout the cremation process.

Figure 5:
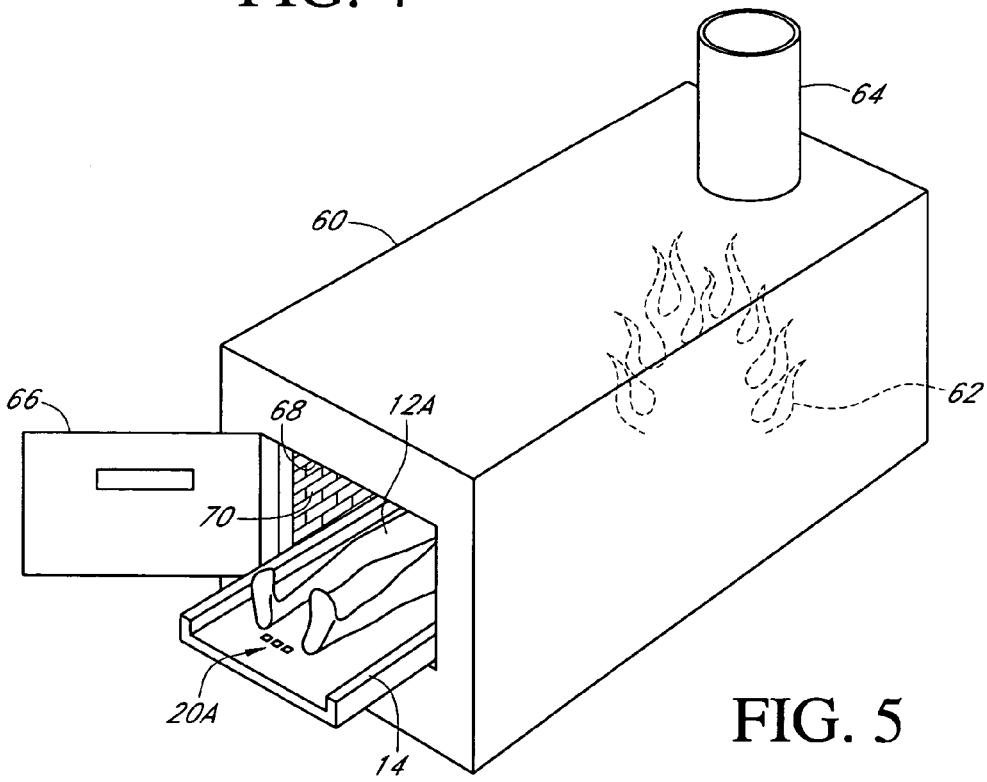
FIG. 5 depicts a perspective view of the deceased individual with the synthetic biometric articles being reduced in a cremation chamber.

The synthetic biometric articles 20A that utilize a color identification synthetic biometric will now be explained with reference to FIG. 5, wherein a cremation process is depicted that provides for the continuous positive identification of a deceased individual. A cremation chamber 60 includes a burner represented by ghosted flame 62 that generates the prolonged high temperatures within the cremation chamber 60 which are required for cremation. The gases resulting from the combustion and cremation process are evacuated through various exhaust systems represented by numeral 64. The base, top, side wall, and end wall construction of the cremation chamber 60 supports stringent mechanical and thermal requirements. A door 66 is open providing an opening 68 into the interior cavity 70 of the cremation chamber 60.

The deceased individual 12A including the synthetic biometric articles 20A is placed within the cremation chamber. It should be appreciated that the deceased individual 12A may be placed in a cremation container which comprises readily combustible materials suitable for cremation. For purposes of explanation, however, the cremation container is not illustrated. Further, the deceased individual 12 may arrive at the crematory with the synthetic biometric article already selected and placed with the deceased individual in a cremation ready container.

The synthetic biometric articles 20A are placed in the dead zone of the cremation chamber 60 near the deceased individual 12A and the bracelet embodiment of the synthetic biometric articles 20A is positioned on the wrist of the deceased individual. It should be appreciated that the optimal positioning of the synthetic biometric articles 20A will depend on the cremation chamber being utilized. As previously discussed, the cameo 16 is not placed within the cremation chamber. Rather the cameo 16 is retained intact as a reference key that associates the particular synthetic biometric the color blue with the deceased individual 12A.

Once the body of the deceased individual 12A is positioned in the cremation chamber 60, the deceased individual 12A and synthetic biometric articles 20A are subject to direct flame and heat and the human remains are reduced to bone fragments 12B through heat and evaporation. Due to its resistance to heat, the synthetic biometric articles 20A are not consumed by the direct flame and heat. Depending on the heat generated by the cremation chamber 60 and the placement of the synthetic biometric articles 20A, however, the synthetic biometric articles 20A may fracture or fragment. The fracturing and fragmenting serves to intermix the synthetic biometric articles 20A with the human remains.

Moreover, the combustible strap of the blue bracelet or wrist band 18 is consumed and the individual pieces of the blue synthetic biometric articles 20A are separated. Regardless of the fracturing and separation, the synthetic biometric articles 20A retain their blue color, which serves as a synthetic biometric for the identification of the human remains.

Figure 6:
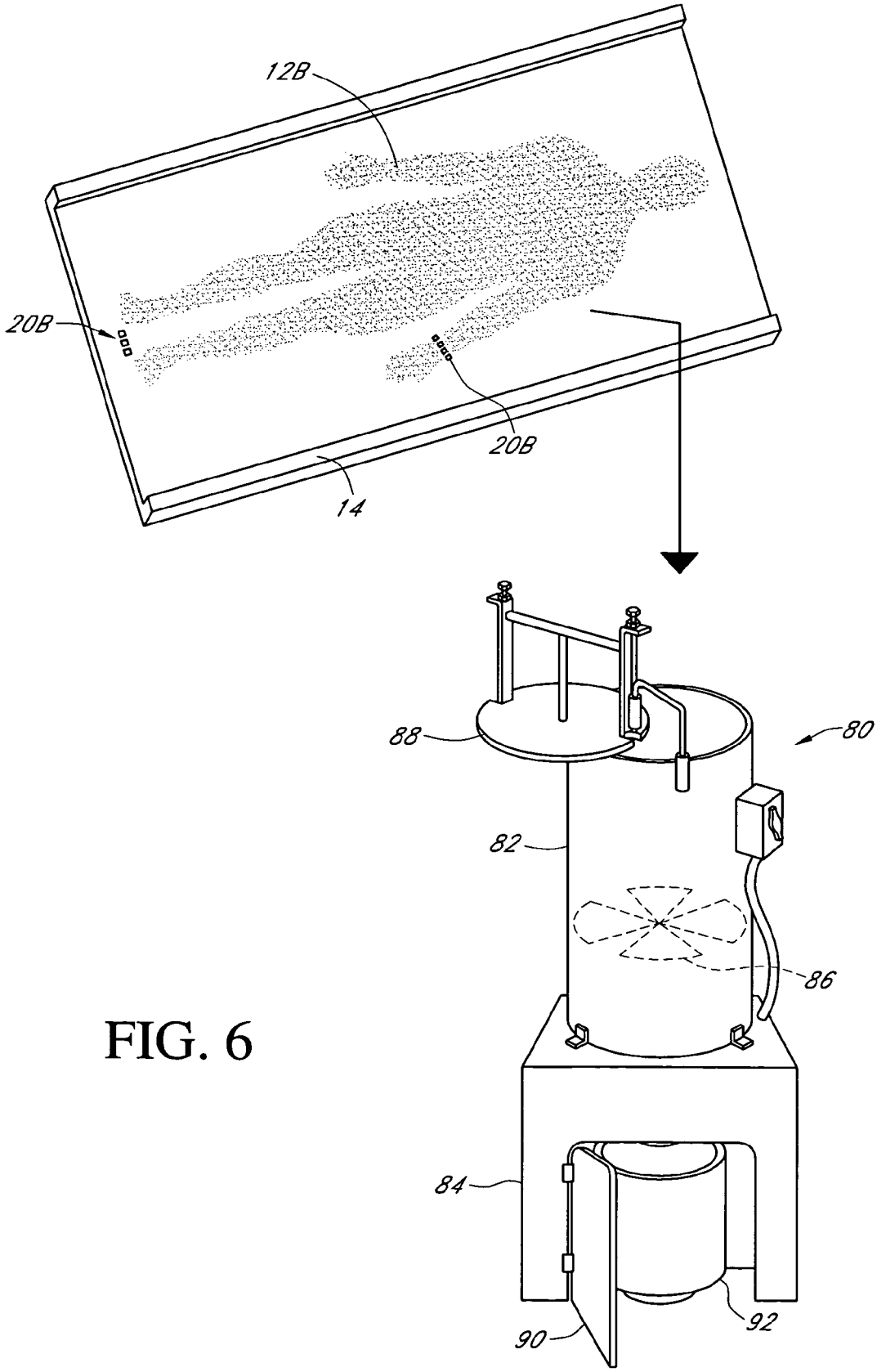
FIG. 6 depicts a perspective view of reduced bone fragments, identifiable by the synthetic biometric articles, being reduced to granulated particles by a grinder.

FIG. 6 depicts a perspective view of reduced bone fragments 12B, identifiable by the fractured and fragmented synthetic biometric articles 20B, being reduced to granulated particles by mechanical pulverization equipment represented by a grinder 80. The grinder 80 includes a housing 82 having an annular cross section positioned atop a base 84. A grinding disk with the necessary motors and controls is represented by the ghosted blade 86 and is mounted in the housing 82. A door 88 provides access to the grinder 80 for loading the human remains 12B and synthetic biometric articles. A second door 90 is located at the base 84 and provides access to a chamber for locating a storage container 92.

As illustrated, the human remains which include bone fragments 12B and the remains of the synthetic biometric articles 20B have been removed from the cremation chamber and the individual pieces of the synthetic biometric articles 20B are partially integrated with the human remains. A steel rake and broom may be used to gather the bone fragments from the cremation chamber. Alternatively, the human remains and synthetic biometric articles are removed from the floor of the cremation chamber and collected into a pan or similar item. Often, the human remains 12B are cooled before being pulverized.

At this time, the bone fragments 12B including the synthetic biometric articles 20B are reduced to granulated particles with the mechanical pulverization equipment. The pulverization serves to intermix the synthetic biometric articles 20A with the human remains. The reduction of the synthetic biometric articles 20B to granulated particles doesn't harm the mechanical pulverization equipment. Further, the color of the synthetic biometric articles 20B remain unchanged and provides for the continued identification of the human remains. In particular, these blue pulverized pieces provide for positive identification of the body by crematory employees as well as family and loved ones.

Figure 7:
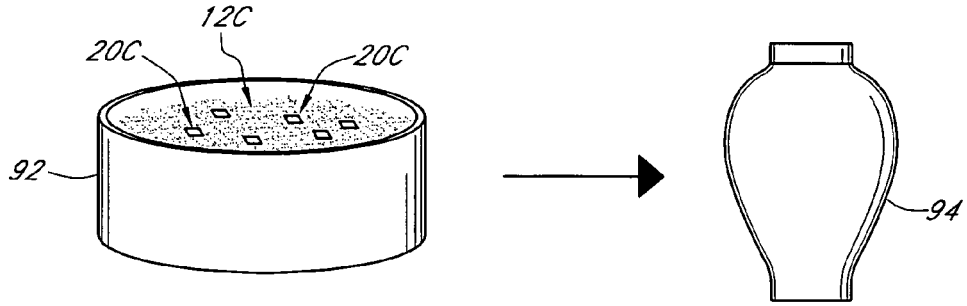
FIG. 7 depicts a perspective view of granulated particles, identifiable by the synthetic biometric articles, being disposed in a urn for final disposition.

FIG. 7 depicts a perspective view of granulated particles 12C, identifiable by the synthetic biometric articles 20C, being disposed in a urn 94 for final disposition. It should be appreciated that the pulverized pieces of the synthetic biometric articles 20C are readily visible within the gray cremated human remains. Accordingly, the synthetic biometric articles 20A-20C provide for the continuous positive identification and verification of identify of a deceased individual 12A through all stages of the cremation process. In particular, the synthetic biometric articles 20A-20C remain associated with and integrated with the human remains throughout the cremation process including the reduction of the deceased individual 12A to bone fragments 12B and the pulverization of the bone fragments 12B to granulate particles 12C, thereby ensuring proper identification.

Figure 8:
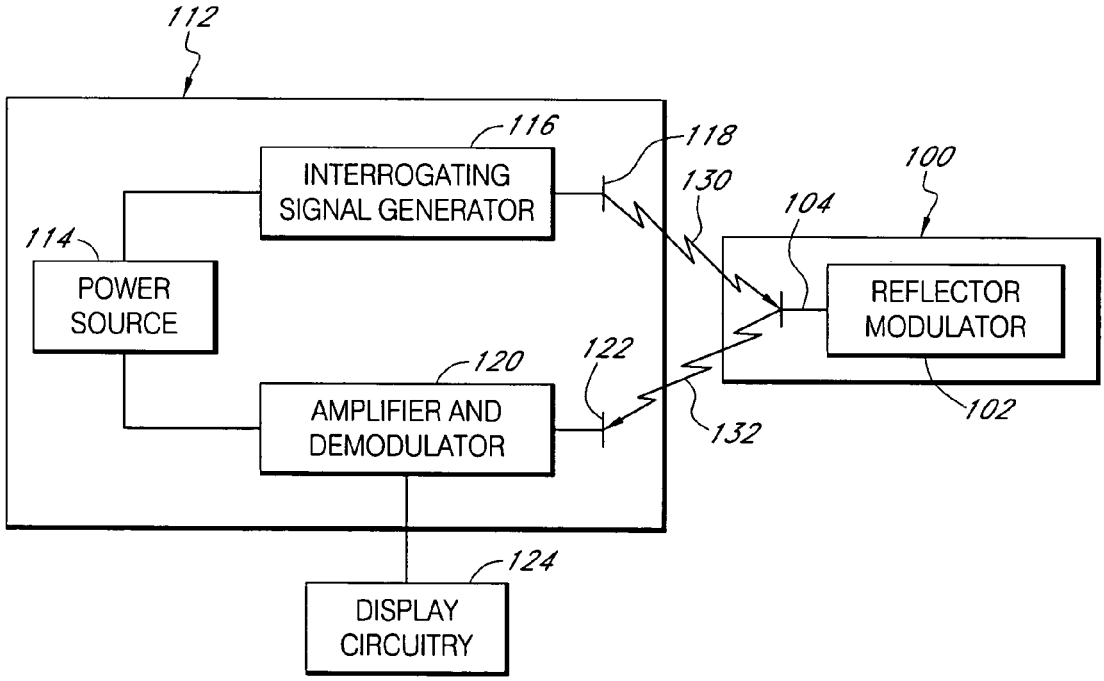
FIG. 8 depicts another embodiment of a synthetic biometric article.

FIG. 8 depicts one embodiment wherein an additional or alternative synthetic biometric may be provided by RFID tags. Each RFID tag 100, which may be considered a synthetic biometric, comprises a small silicon microprocessor or reflector/modulator 102 and an antenna 104, which may be copper, aluminum, or carbon, for example, that are encapsulated in a protective material such as a polymer. Preferably, each RFID tag 100 is smaller than the eventual granulated particles. A plurality of the RFID tags may be associated with a single unique radio frequency identifier and dispersed within the cremation compatible material or within several pieces of cremation compatible material. In one implementation, each individual cremated at the crematory is assigned a unique rf signal for positive identification. By using a plurality of RFID tags, the inevitable destruction of a portion of the RFID tags will not affect the positive identification of the human remains.

These inductive RFID tags are powered by the magnetic field generated by a reader 112 which may comprise a power source 114, an interrogating signal generator 116 with a sending transducer or antenna 118. In addition, the reader may also comprise an amplifier and demodulator 120 operably connected to a signal receiving transducer or an antenna 122. The reader 112 generates an interrogating signal or magnetic field 130 which, in turn, is modulated by the RFID tag 100 and transmitted back to the reader as a response signal 122. The reader 112 analyzes the received response signal 122 to determine the unique radio frequency identifier, thereby enabling the positive identification of the human remains. The unique radio frequency and/or other identifying information may be displaced on display circuitry 124, which may have access to an identification database, to provide for positive identification of the body by crematory employees as well as family and loved ones at any stage during the cremation process.

In another implementation of the RFID tags, the functional portion of the RFID tag consists of either an antenna and diode or an antenna and capacitors that form a resonant circuit. When placed in an electromagnetic field generated by a reader, the antenna-diode marker generates harmonics of the interrogating frequency in the receiving antenna. The resonant circuit marker causes an increase in absorption of the transmitted signal so as to reduce the signal in a receiving coil. The detection of the harmonic or signal level change by the reader indicates the presence and signature of the RFID tag, thereby enabling positive identification of the human remains.

In a further implementation of the RFID tags, each RFID tag includes a first elongated element of high magnetic permeability ferromagnetic material disposed adjacent to at least a second element of ferromagnetic material having higher coercivity than the first element. When subjected to an interrogation frequency of electromagnetic radiation, the reader causes harmonics of the interrogating frequency to be developed in the receiving coil of the reader. The detection of such harmonics by the reader indicates the presence of RFID tag and the unique radio frequency identifier associated with the RFID tag.

Figure 9:
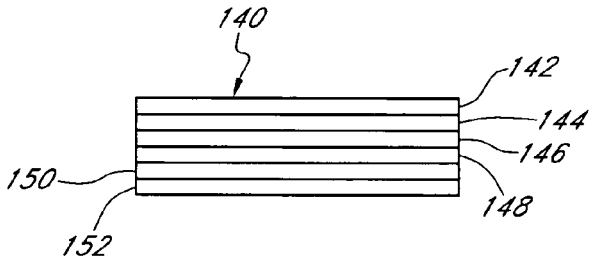
FIG. 9 depicts a further embodiment of a synthetic biometric article.

FIG. 9 depicts another embodiment wherein an additional or alternative synthetic biometric may be provided by micro particle identification. A plurality of identical micro particles, which each may be considered a synthetic biometric or synthetic biometric article, may be dispersed within the cremation compatible article. Each micro particle 140 may be formed from one to ten layers of a randomly shaped, chemically stable thermoplastic resin. As depicted, the micro particle 140 includes five layers, layers 142-150. Each of the layers is a different color to create a custom numerical color combination code that may be utilized to identify an individual. A hand-held video microscope may be utilized to rapidly and accurately identify the unique color codes present in the synthetic biometric articles remaining in the human remains.

Figure 10:
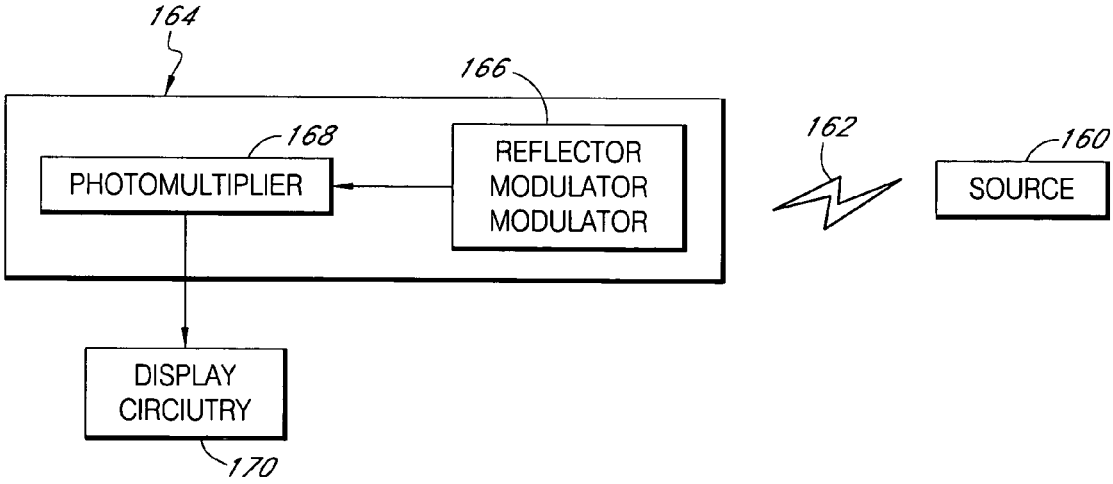
FIG. 10 also depicts a further embodiment of a synthetic biometric article.

FIG. 10 depicts a further embodiment wherein an additional or alternative synthetic biometric may be provided by chemical identification tags such as chemical identification tag or source 160, which may be considered a synthetic biometric or synthetic biometric material, that emits gamma rays 162. More specifically, a variety of unique gamma-emitting tracer isotopes are suitable for use within the cremation compatible article. Such tracer isotopes include but not are limited to Gold$^{198}$, Xenon$^{133}$, Iodine$^{131}$, Rubidium$^{86}$, Chromium$^{51}$, Iron$^{59}$, Antimony$^{124}$, Stontium$^{85}$, Cobalt$^{58}$, Iridium$^{192}$, Scandium$^{46}$, Zinc$^{65}$, Siler$^{110}$, Cobalt$^{57}$, Cobalt$^{60}$, and Krypton$^{85}$. In one implementation, each individual cremated is assigned a unique isotope combination to ensure the proper identification of remains. A reader 164 may be a gamma ray detecting system, such as a thallium activated sodium iodide crystal 166 coupled to a low noise photomultiplier 168 having appropriate electronics associated therewith including display circuitry 170 and an identification database. The reader 164 detects gamma rays 162 that originate from the unique gamma-emitting tracer source isotopes 160 that are embedded within the cremation compatible material, thereby enabling positive identification of the human remains.

The application of the synthetic biometric articles presented herein is not limited to cremation. The synthetic biometric articles may be used for burial and internment. One or more synthetic biometric articles may be buried with a deceased individual. Alternatively, the one or more synthetic biometric articles may be attached or injected into the deceased individual. The synthetic biometric articles may play a vital role in verification of a deceased's identity or exact location of burial in instances of displacement by acts of nature or vandalism where decomposition of the body is such that its identity or location are not readably determinable.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A synthetic biometric article for use in cremation and burial processes of a deceased individual, the synthetic biometric article comprising:

a body including a cremation compatible material that is suitable for mechanical pulverization, the body being operable to be placed with the deceased individual; and at least one synthetic biometric integrated into the cremation compatible material, the at least one synthetic biometric providing identification of the deceased individual during the cremation process, wherein the at least one synthetic biometric comprises an article selected from the group consisting of a radio frequency identification tag, a micro particle identification resin, and a chemical identification tag.

2. The synthetic biometric article as recited in claim 1, wherein the cremation compatible material comprises a material selected from the group consisting of porcelains, ceramics, polymers, and composites.

3. The synthetic biometric article as recited in claim 1, wherein the body is mounted onto a strap of a bracelet.

4. The method for providing identification of a deceased individual during the cremation process, the method comprising:

selecting a synthetic biometric article for the deceased individual;

placing the deceased individual and the synthetic biometric article in a cremation chamber;

reducing the deceased individual to bone fragments through heat and evaporation;

removing the bone fragments and the synthetic biometric article from the cremation chamber;

identifying the bone fragments by the synthetic biometric article;

placing the bone fragments and synthetic biometric article into a grinder;

reducing the bone fragments to granulated particles;

removing the granulated particles and synthetic biometric article from the grinder; and identifying the bone fragments by the synthetic biometric article.

5. The method as recited in claim 4, further comprising placing the granulated particles and the synthetic biometric article into an urn for final disposition.

6. The method as recited in claim 4, wherein reducing the deceased individual to bone fragments further comprises fragmenting the synthetic biometric article.

7. The method as recited in claim 6, further comprising intermixing the bone fragments and the synthetic fragmented biometric article.

8. The method as recited in claim 4, wherein reducing the bone fragments to granulated particles further comprises fragmenting the synthetic biometric article.

9. The method as recited in claim 8, further comprising intermixing the granulated particles and the fragmented synthetic biometric article.

10. The method as recited in claim 4, wherein selecting a synthetic biometric article further comprises selecting the synthetic biometric to be a heat resistant colored pigment.

11. The method as recited in claim 4, wherein selecting a synthetic biometric article further comprises selecting a synthetic biometric from the group consisting of radio frequency identification tags, micro particle identification resins, and chemical identification tags.

* * * * *